US005893477A

United States Patent [19]

Kaneko et al.

[11] Patent Number: 5,893,477

[45] Date of Patent: Apr. 13, 1999

[54] RECEPTACLE FOR LIQUIDS

[75] Inventors: Masamichi Kaneko, Tokyo; Hidetoshi Konno, Kanagawa; Junichi Satoyoshi, Tokyo, all of Japan

[73] Assignee: Tetra Laval Holdings & Finance S.A., Pully, Switzerland

[21] Appl. No.: 08/849,115

[22] PCT Filed: Nov. 29, 1995

[86] PCT No.: PCT/US95/15456

§ 371 Date: Jul. 21, 1997

§ 102(e) Date: Jul. 21, 1997

[87] PCT Pub. No.: WO96/16871

PCT Pub. Date: Jun. 6, 1996

[30] Foreign Application Priority Data

Nov. 29, 1994 [JP] Japan ..... 6-319045

[51] Int. Cl.[6] ..... B65D 51/20

[52] U.S. Cl. ..... 220/257; 220/359.2; 220/254

[58] Field of Search ..... 220/254, 256, 220/257, 259, 268, 269, 270, 711, 712, 713, 359.2; 215/251

[56] References Cited

U.S. PATENT DOCUMENTS

| | | | |
|---|---|---|---|
| 3,438,533 | 4/1969 | Hanisch et al. | 220/257 |
| 3,690,506 | 9/1972 | Kennedy et al. . | |
| 4,087,018 | 5/1978 | Tebbutt . | |
| 4,300,700 | 11/1981 | Chang . | |
| 4,355,742 | 10/1982 | Scholle | 220/257 X |
| 4,518,096 | 5/1985 | Winstead . | |
| 4,562,936 | 1/1986 | Deflander | 220/257 X |
| 4,582,216 | 4/1986 | Byrd . | |
| 4,708,258 | 11/1987 | Deline . | |
| 4,927,048 | 5/1990 | Howard . | |
| 5,007,231 | 4/1991 | Ingemann . | |
| 5,071,017 | 12/1991 | Stuli . | |
| 5,647,497 | 7/1997 | Labbe | 220/257 |
| 5,688,544 | 11/1997 | Bolton et al. | 220/270 X |

FOREIGN PATENT DOCUMENTS

| | | | |
|---|---|---|---|
| 2252963 | 8/1992 | United Kingdom | 220/257 |

*Primary Examiner*—Stephen K. Cronin
*Assistant Examiner*—Nathan Newhouse
*Attorney, Agent, or Firm*—Burns, Doane, Swecker & Mathis, L.L.P.

[57] ABSTRACT

A receptacle for a beverage includes a cylindrical main body (10)having an open upper end (11) that is closed by a plastic lid (20). The plastic lid (20) is provided with an opening (23) for use in drinking or otherwise discharging the contents of the container. The opening (23) can be covered with a pull tab (30) or can be left uncovered. The lid (20) is provided with a flange (21) at a portion surrounding the outer periphery of the lid (20), and a cover film (50) is sealed to the flange (21) to cover the lid (20). The upper surface of the lid (20) is shielded from outside air by the cover film (50) and therefore can be maintained in a clean condition until the opening (23) is exposed for discharging the contents in the receptacle. Thus, dust, moisture and other contaminants are prevented from becoming deposited on the lid (20).

12 Claims, 3 Drawing Sheets

RECEPTACLE FOR LIQUIDS

FIELD OF THE INVENTION

This invention relates to a receptacle or container for containing contents and more particularly to a container or receptacle for containing milk, juice or other type of drink having a pour opening for permitting the contents to be discharged from the receptacle.

BACKGROUND OF THE INVENTION

There is a known receptacle or container for a drink having a cylindrical structure in which an opening for use in discharging the drink is formed in an upper lid and is closed by a pull tab. A consumer, after removing the pull tab, can drink the contents in the receptacle directly from the opening. In this type of a drink receptacle, however, dust tends to deposit on the lid during transportation and storage. When the lid is formed of a plastic material, dust is particularly apt to deposit on the lid due to static electricity and the deposits once formed are hard to remove. In the presence of this dust, it is unsanitary to directly touch the opening with the mouth.

While a large pull tab can cover the vicinity of the opening, it is impossible to entirely cover the lid with the pull tab. Thus, a large pull tab cannot effectively prevent the deposition of dust on the lid.

There is also a method by which the deposition of dust is prevented and this involves fitting a molded plastic cover over the upper lid. With this method, however, a tight seal cannot be provided between the plastic cover and the lid and so it is possible for water, etc. to enter the space between the lid and the cover.

In receptacles for drinks formed of plastic or a laminate and used for purposes of relatively long term storage, a film having oxygen barrier properties is used to prevent the deterioration of the contents. If such a film is used for each of the parts of the container or receptacle such as the upper lid and the pull tab attached to the upper lid, the receptacle production steps are inevitably complicated and so the production costs are increased.

SUMMARY OF THE INVENTION

The present invention addresses the foregoing problems by providing a receptacle or container for a drink which can prevent the deposition of dust and water, and which can be easily imparted with barrier properties. According to one aspect of the invention, a receptacle or container for a drink includes a cylindrical receptacle main body having an open upper end that is closed by a plastic lid provided with an opening for use in drinking. The opening is covered with an openable pull tab and the outer periphery of the lid is provided with a flange. A cover film is sealed to the flange to cover the lid.

In another form of the invention, a receptacle or container for a drink includes a cylindrical receptacle main body having an open upper end that is closed by a plastic lid provided with an opening for use in drinking. The lid is provided with an upstanding flange that surrounds at least the opening in the lid. A cover film is sealed to the flange to cover the lid.

Since the cover film is sealed so as to cover the upper lid or the opening in the lid, the upper surface of the lid or the portion of the lid containing the opening is shielded from the outer atmosphere. Thus, there is no fear of deposition of dust or water on the upper surface of the lid, particularly in the area of the lid where the opening is located. Thus, the upper surface of the lid can be maintained clean until the opening is actually exposed.

When the container or receptacle main body is made of a material possessing oxygen barrier properties, the cover film having a relatively simple construction is formed of a film material also having oxygen barrier properties. This does away with the need for imparting barrier properties to the upper lid and the pull tab.

BRIEF DESCRIPTION OF THE DRAWING FIGURES

The foregoing features and advantages, in addition to others, will be more readily understood by the following detailed description of the invention considered in conjunction with the accompanying drawing figures in which like elements are identified by like reference numerals and wherein.

DETAILED DESCRIPTION OF THE INVENTION

Figure 1:
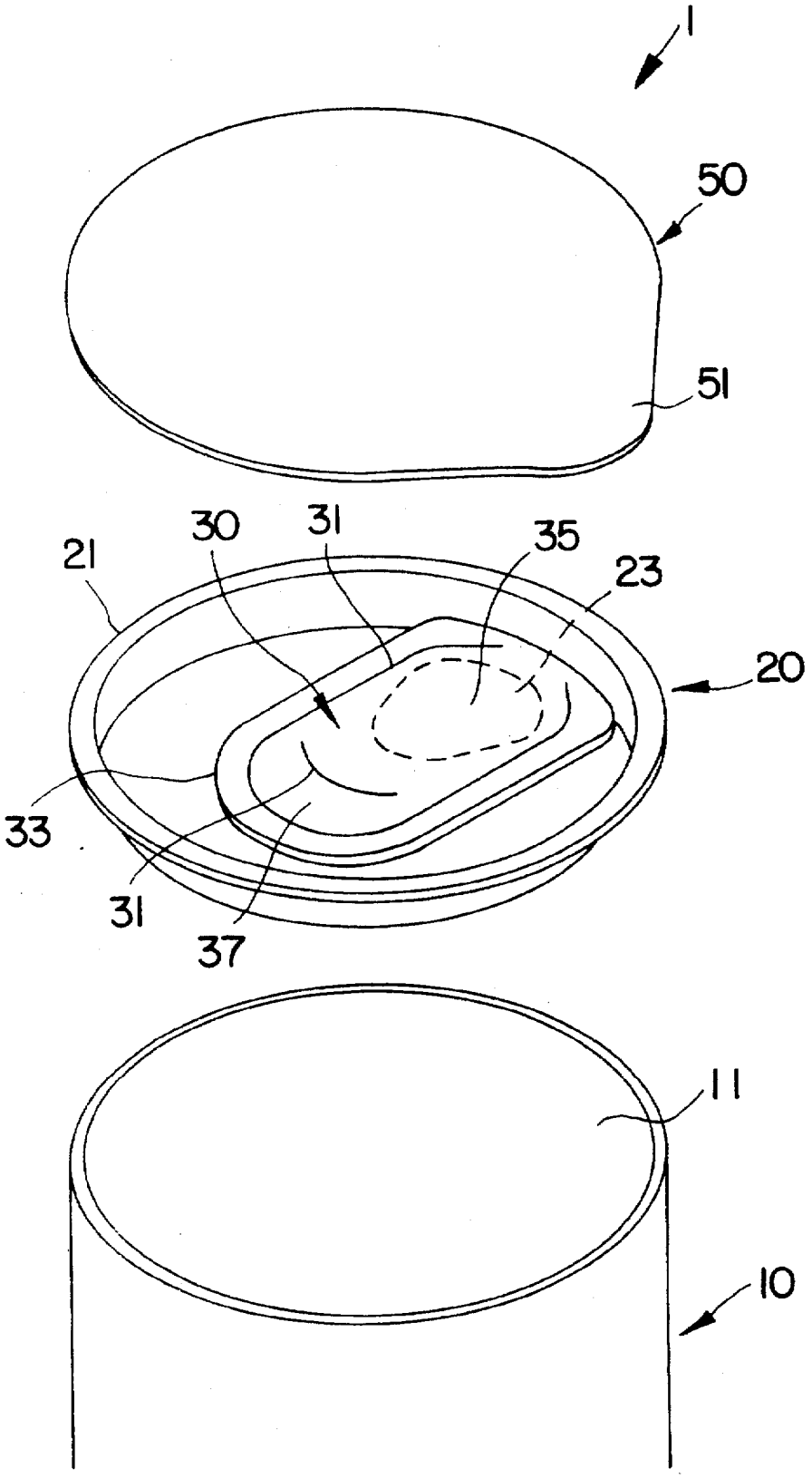
FIG.1 is an exploded perspective view of a portion of a receptacle according to one embodiment of the present invention illustrating the receptacle main body, the lid, the pull tab and the cover film.

FIG. 1 illustrates in exploded perspective view an upper portion of a receptacle or container for holding consumable liquid such as milk, juice or other types of drinks in accordance with one embodiment of the present invention. Generally speaking, the receptacle 1 includes a cylindrical receptacle main body 10 having an open upper end 11 which is closed by an upper lid 20 formed of a plastic material. A cover film 50 is provided to cover the upper lid 20 so that the upper surface of the lid 20 is sealed.

More specifically, the receptacle main body 10 is constructed from a laminated sheet which is formed of synthetic resins and which is shaped into a cylindrical shape. The receptacle 1 also includes a bottom plate (not shown) which is formed of a similar material and which is attached to the lower end of the main body 10. The sheet or material constituting the receptacle main body 10 is constructed, for example to have an EVOH (an ethylene/vinyl alcohol copolymer) layer possessing oxygen barrier properties. Other layers (e.g., an adhesive layer, etc.) are interposed between polyolefin (such as polyethylene) layers. This imparts oxygen barrier properties to the receptacle main body 10. The sheet can be shaped into the desired shape of the main body by, for example, vacuum molding. It is, of course, to be understood that the material constituting the receptacle main body 10 can take other forms, such as a sheet using paper and a metal layer.

The upper lid 20 is in the form of an approximately circular plate having an outer periphery provided with an upwardly protruded or extending flange 21 arranged to surround the lid 20. A through opening 23, shown by dotted outline in FIG. 1, is formed at a predetermined location in the upper lid 20. The through hole 23 communicates with the interior of the main body 10 to permit the contents to be drunk or otherwise discharged from the receptacle main body 10. The upper lid 20 is preferably formed by vacuum molding a plastic sheet made of a relatively inexpensive material having no oxygen barrier properties.

A pull tab 30 made of a resin film is covers the opening 23 in the upper lid 20 to close and seal the opening 23. The pull tab 30 is secured to the upper surface of the upper lid 20. The pull tab 30 is approximately elliptical or ovaloid in shape and has a predetermined cut line 31 to thereby form a handle portion 33, an opening-sealing portion 35 and a fixing portion 37.

The cover film 50, which is approximately circular in shape, is formed by punching out from a sheet having a barrier property similar to that of the sheet constituting the receptacle main body 10. The cover film 50 has the same or substantially the same diameter as that of the upper lid 20 and is provided with an outwardly extending manually graspable tag portion 51 at a predetermined position on the outer periphery. The tag portion 51 extends outwardly beyond the outer periphery of the upper lid 20, thereby facilitating grasping of the tag portion 51 and subsequent removal of the cover film 50.

In the preparation of the receptacle 1. the upper lid 20 is mounted on the opened end 11 of the receptacle main body 10 containing a drink. In this case, the lower side of the flange 21 provided around the outer periphery of the upper lid 20 is thermally fuse-bonded to the upper side of the receptacle main body 10 to effect sealing. Then, the cover film 50 is mounted to cover the upper lid 20. In the preferred form of the invention, the lower side of the periphery of the cover film 50 is thermally fuse-bonded to the upper side of the flange 21 of the lid 20 for effecting the necessary sealing. The sealing may be effected by use of an adhesive.

Figure 2:
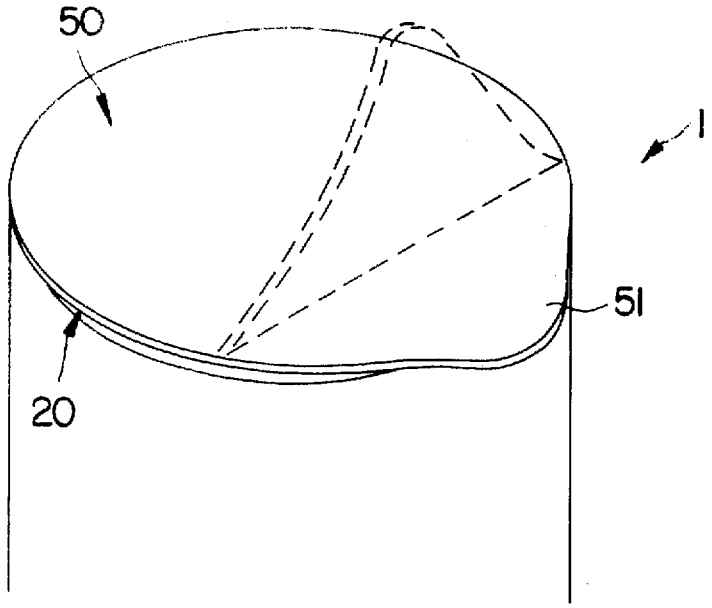
FIG. 2 is a perspective view of a portion of the receptacle shown in FIG. 1 with the cover film sealed to the lid.

FIG. 2 is a perspective view showing the upper portion of a thus prepared receptacle 1 for a drink. In this receptacle 1, since the entire upper lid 20 is covered and sealed with the cover film 50, dust and moisture are prevented from entering from outside on the upper lid 20. Therefore, the periphery of the opening 23 (see FIG. 1) for use in drinking is prevented from being fouled by dust and other potential contaminants.

To open the opening 23 in the lid 20 of the receptacle 1, the tag portion 51 of the cover film 50 is first grasped and pulled upward as shown by the dotted line configuration in FIG. 2. The cover film 50 is thus peeled off from the upper lid 20.

Figure 3:
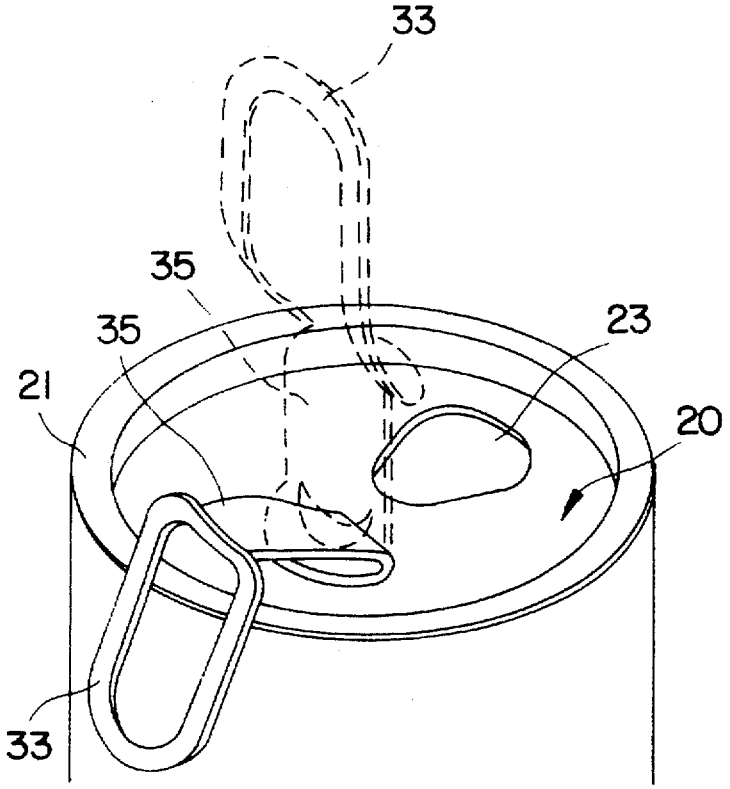
FIG. 3 is a perspective view of the receptacle shown in FIG. 2 showing the cover film removed and the pull tab opened.

Next, the handle portion 33 of the pull tab 30 is pulled upward to peel the opening-sealing portion 35 off from the upper lid 20 as shown by the dotted line configuration in FIG. 3. Further, the handle portion 33 of the pull tab 30 is caught by the flange 21 of the upper lid 20 as shown by the solid line in FIG. 3. Thus, the opening 23 in the lid 20 is in the opened state.

The pull tab used in the receptacle according to the present invention is not limited to the specific structure illustrated and described above. Pull tabs having various other structures such as a structure in which a sheet-like pull tab is applied may be employed. Also, when no barrier property is required for the receptacle 1, the cover film 50 may be formed of a relatively inexpensive material having no barrier properties. Further, the receptacle main body is not limited to a circular form as other shapes may be employed.

Figure 4:
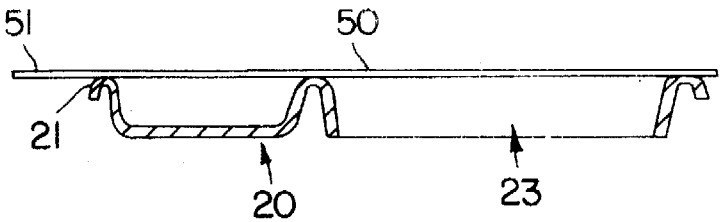
FIG. 4 is a cross sectional view of a lid and cover film utilized in a receptacle in accordance with another embodiment of the invention.
Figure 5:
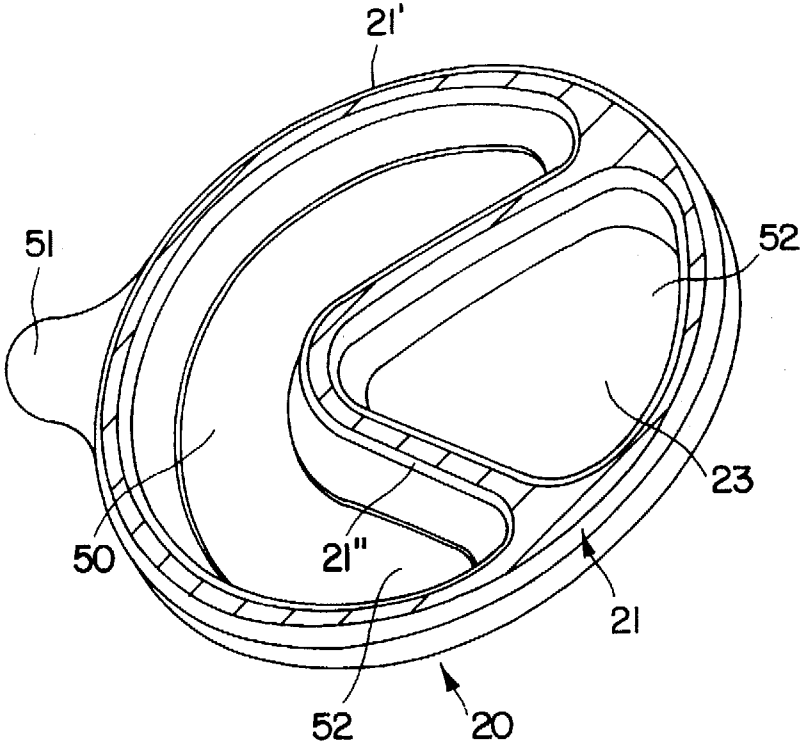
FIG. 5 is a perspective view of the lid and cover film shown in FIG. 4.

Another embodiment of the present invention is illustrated in FIGS. 4 and 5 which depict the features associated with the lid and the cover film. Although not specifically illustrated in FIGS. 4 and 5, is the same as the main body depicted in FIGS. 1–3. As seen with reference to FIGS. 4 and 5, this alternative embodiment of the invention employs an upper lid 20 formed of a plastic material and a cover film 50 provided on and sealed to the upper lid 20. The upper lid 20 is provided with an upwardly extending flange 21 arranged to surround the lid 20, and an opening 23 for use in drinking or otherwise discharging the contents from the receptacle. The flange 21 includes a portion 21' extending completely around the periphery of the lid 20 as well as another portion 21" that extends across the lid 20 from one point on the periphery of the lid 20 to another point on the periphery of the lid 20. Thus, a portion of the upwardly extending flange 21 encircles the opening 23 that is provided in the lid 23 as seen in FIG. 5. In this embodiment, the upper lid 20 may be formed from a plastic sheet material made of a relatively inexpensive material having no barrier property. Also, a pull tab is not attached on the opening 23. Rather, the opening is left uncovered except for the cover film 50.

The cover film 50 may be formed from a sheet having a barrier middle layer and an easy peal outer layer. The cover film 50 has an outwardly extending manually graspable tag portion 51 at a position located along the outer periphery of the cover film 50. The tag portion 51 preferably extends beyond the outer periphery of the lid 20 and the flange 21.

The cover film 50 is thermally fuse-welded to the upper side of the flange 21 of the lid 20 along both the flange portion 21' encircling the outer periphery of the lid 20 as well as the flange portion 21" extending across the lid 20. Thus a continuous seal is formed and two weld or seals areas 52 are provided.

Since the whole of the upper lid 20 and the opening 23 are covered and sealed with the cover film 50, the cover film 50 prevents outside dust and moisture from being deposited on the lid 20. Further, the seal provided by the cover film 50 prevents the contents in the receptacle from leaking.

To open the opening 23, the tag portion 51 of the cover film 50 is first grasped and pulled upward. The cover film 50 is thus peeled off from the upper lid 20 as well as the opening 23. The contents in the receptacle can then be drunk directly from the receptacle or can otherwise be discharged from the receptacle.

Figure 6:
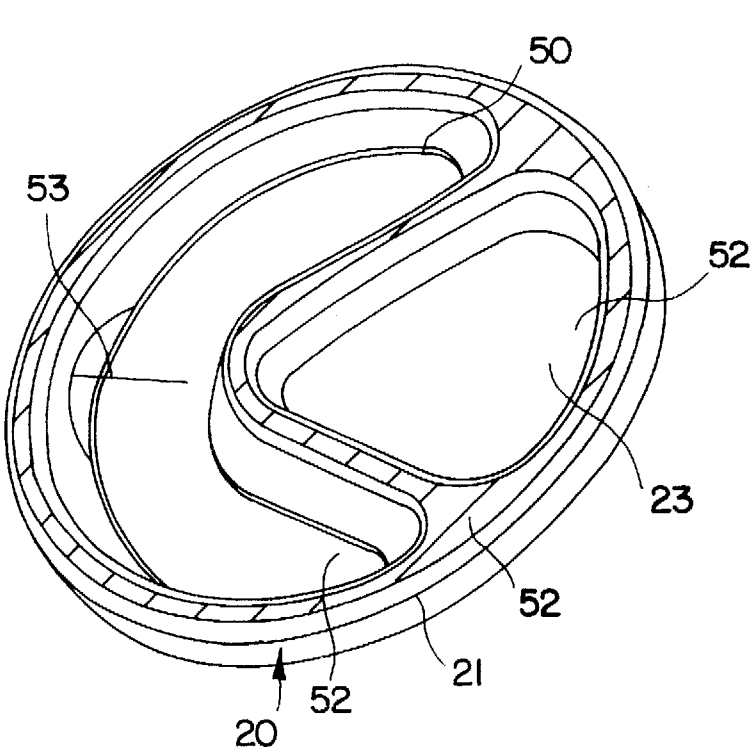
FIG. 6 is a perspective view of the lid shown in FIG. 4 and 5 with a slightly different form of the cover film.

FIG. 6 is a perspective view of another embodiment of the invention that is similar to the embodiment depicted in FIGS. 4 and 5 except that instead of the tag portion 51, the cover film 50 is provided with a cut line 53 for easy peeling of the cover film 50. An individual can penetrate the cover film 50 at the cut line 53 and then remove the cover film 50 by peeling the cover film 50 off the upper lid 20.

It can be appreciated that the present invention provides significant advantages with respect to other known types of receptacles. In one respect, since the upper lid is sealed and covered by the cover film, the upper surface of the lid is shielded from outside, thereby eliminating the possibility of dust and moisture being deposited on the lid. Thus, the upper surface of the lid can be maintained clean and sanitary until the opening of the receptacle.

In addition, when it is necessary for the receptacle to possess barrier properties, the upper lid and the pull tab need not also be made of a material having barrier properties. Rather, it is sufficient that the cover film having a simple structure be formed of a material exhibiting barrier properties. Thus, the production costs can be reduced.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A receptacle for holding contents comprising a cylindrical main body portion made of a material having oxygen barrier properties, said main body having an interior and an open upper end, a generally circular plastic lid secured to the open upper end of the main body to cover the open upper end of the main body, said plastic lid having an upwardly extending flange including a first portion disposed around a periphery of the lid and a second portion that divides an upwardly facing surface of the lid into two regions that are separated from one another, said plastic lid including a through opening communicating with the interior of the main body to allow the contents in the interior of the main body to be discharged, and a generally circular cover film sealed to the first end second portions of the flange of the plastic lid to cover and seal the lid underlying the cover film, and prevent dust and other material from being deposited on the lid, said cover film being made of a plastic material having barrier properties.

2. A receptacle according to claim 1, wherein said plastic lid is made of a material different from the material from which the main body is made.

3. A receptacle according to claim 1, including a pull tab secured to the plastic lid and covering the through opening, said pull tab being at least partially releasable from the plastic lid to uncover the through opening and allow the contents to be discharged from the main body.

4. A receptacle according to claim 1, wherein said cover film includes a manually graspable tag portion extending outwardly beyond the lid to facilitate removal of the cover film.

5. A receptacle according to claim 1, wherein said cover film includes a cut line to facilitate removal of the cover film from the plastic lid.

6. A receptacle containing a consumable liquid, comprising a cylindrical main body having an open upper end, said cylindrical main body being made of a material possessing oxygen barrier properties, a generally circular plastic lid secured to the open upper end of the main body to close the open upper end of the main body, said plastic lid having an upwardly extending flange including a first portion disposed around a periphery of the lid and a second portion that divides an upwardly facing surface of the lid into two regions that are separated from one another, said plastic lid being made of a material different from the material from which the main body is made, a through opening provided in the plastic lid for allowing the liquid to be emptied from the main body, a pull tab covering the opening and secured to the plastic lid, said pull tab having a graspable handle portion for allowing at least a portion of the pull tab to be released from the plastic lid to expose the opening in the plastic lid, and a generally circular removable cover film sealed to the first and secondary portion of facing surface of the plastic lid for preventing dust and other material from becoming deposited on the upwardly facing surface of the lid, said cover film being made of a plastic material possessing oxygen barrier properties.

7. A receptacle according to claim 6, wherein said pull tab includes a cut line for controlling opening of the pull tab when the handle portion of the pull tab is grasped and pulled for exposing the opening in the plastic lid.

8. A receptacle according to claim 6, wherein said cover film includes an outwardly extending manually graspable tag portion for facilitating removal of the cover film from the plastic lid, said tag portion extending outwardly beyond the periphery of the lid.

9. A receptacle containing a consumable liquid, comprising a cylindrical main body having an interior and an open upper end, said cylindrical main body being made of a material possessing oxygen barrier properties, a plastic lid secured to the open upper end of the main body to close the open upper end of the main body, said plastic lid including a through opening communicating with the interior of the main body for allowing the liquid to be discharged from the main body, said plastic lid having an upwardly facing surface and a flange that extends upwardly from the upwardly facing surface so that the flange is raised above the upwardly facing surface, said flange including a first portion extending around the entire periphery of the plastic lid and a second portion extending across the plastic lid from one region on the periphery of the lid to another region on the periphery of the lid, said second portion of the flange dividing the upwardly facing surface of the lid into two regions that are separated from one another, said plastic lid being made of a material different from the material from which the main body is made, a cover film made of a material having oxygen-barrier properties sealed to the first and second portions of the flange to cover the upwardly facing surface of the plastic lid and prevent dust and other material from being deposited on the plastic lid.

10. A receptacle according to claim 9, wherein said cover film includes a manually graspable tag portion extending beyond an outer periphery of the plastic lid for facilitating removal of the cover film.

11. A receptacle according to claim 9, wherein said cover film includes a cut line for facilitating removal of the cover film.

12. A receptacle according to claim 9, wherein said through opening is uncovered.

* * * * *